US009955754B2

(12) United States Patent
Liu

(10) Patent No.: US 9,955,754 B2
(45) Date of Patent: May 1, 2018

(54) SHOELACE STRUCTURE

(71) Applicant: KAE SHENG INDUSTRIAL CO., LTD., Lugang Township, Changua County (TW)

(72) Inventor: Tsai-Chen Liu, Lugang Township (TW)

(73) Assignee: Kae Sheng Industrial Co., Ltd., Lugang Township (TW)

( * ) Notice: Subject to any disclaimer, the term of this patent is extended or adjusted under 35 U.S.C. 154(b) by 316 days.

(21) Appl. No.: 15/057,202

(22) Filed: Mar. 1, 2016

(65) Prior Publication Data

US 2017/0251763 A1 Sep. 7, 2017

(51) Int. Cl.
*A43C 9/00* (2006.01)
*A43C 1/00* (2006.01)

(52) U.S. Cl.
CPC . *A43C 1/00* (2013.01); *A43C 9/00* (2013.01)

(58) Field of Classification Search
CPC ..... A43C 9/00; Y10T 24/3726
USPC ..... 24/715.3, 712
See application file for complete search history.

(56) References Cited

U.S. PATENT DOCUMENTS 1,997,771 A * 4/1935 McGowan ..... D01H 5/36 139/426 R
2,141,801 A * 12/1938 Taft ..... A43C 9/00 24/713
3,110,945 A * 11/1963 Howe, Jr. ..... A43C 9/00 24/713
4,858,282 A * 8/1989 Dupont, Jr. ..... A43C 9/00 24/712
5,287,601 A * 2/1994 Schweitzer ..... A43C 9/00 24/300
5,673,546 A * 10/1997 Abraham ..... A43C 9/00 24/713
D769,607 S * 10/2016 Martinson ..... D2/978
9,888,744 B2 * 2/2018 Cogliandro ..... A43C 7/005
2005/0217089 A1 * 10/2005 Lin ..... A43C 9/00 24/712
2006/0168785 A1 * 8/2006 Kraft ..... A43C 1/02 24/715.3
2012/0144631 A1 * 6/2012 Stanev ..... A43C 1/02 24/715.3
2013/0255045 A1 * 10/2013 Gonzalez ..... A43C 9/00 24/715.3

(Continued)

*Primary Examiner* — Jack W Lavinder
(74) *Attorney, Agent, or Firm* — Alan D. Kamrath; Kamrath IP Lawfirm, P.A.

(57) ABSTRACT

A shoelace structure includes an outer sleeve, a liner mounted in the outer sleeve, and an inner core mounted in the liner. The inner core includes a first weaving thread and a plurality of second weaving threads. The first weaving thread interweaves and intertwines with the second weaving threads, with the second weaving threads being secured to the first weaving thread, thereby defining a plurality of enlarged portions and a plurality of separation portions. The liner is squeezed by the enlarged portions of the inner core and defines a plurality of expanded sections and a plurality of recessed sections. The expanded sections of the liner respectively corresponds to the enlarged portions of the inner core, and the recessed sections of the liner respectively corresponds to the separation portions of the inner core.

10 Claims, 5 Drawing Sheets

(56) References Cited

U.S. PATENT DOCUMENTS

| | | | | |
|---|---|---|---|---|
| 2015/0047159 | A1* | 2/2015 | Lin | A43C 9/00 24/715.4 |
| 2016/0302529 | A1* | 10/2016 | Cogliandro | A43C 7/005 |
| 2017/0065026 | A1* | 3/2017 | Wu | A43C 1/02 |

* cited by examiner

SHOELACE STRUCTURE

BACKGROUND OF THE INVENTION

1. Field of the Invention

The present invention relates to a lace and, more particularly, to a shoelace structure for one of a pair of shoes.

2. Description of the Related Art

A conventional shoelace structure comprises a solid lace including a plurality of projections and a plurality of reduced portions located between the projections. Thus, when the solid lace is tied on one shoe, the projections are stopped by the eyelets of the shoe to prevent the solid lace from slipping due to an external pulling force. However, the projections and the reduced portions are arranged on the solid lace, thereby decreasing the outer appearance of the solid lace. In addition, the solid lace is provided with the projections, thereby increasing the cost of fabrication. Further, the solid lace is provided with the projections and the reduced portions so that the solid lace is not made easily, thereby causing inconvenience in fabrication of the solid lace, and thereby increasing the working time.

Another conventional shoelace structure comprises a hollow outer layer and an inner core mounted in the outer layer. The inner core is provided with a plurality of projections which are formed by knotting. Thus, when the outer layer is tied on one shoe, the projections are stopped by the eyelets of the shoe to prevent the outer layer from slipping due to an external pulling force. However, the projections are successively formed on the inner core by knotting, so that the inner core is not made easily and quickly, thereby causing inconvenience in fabrication of the inner core, and thereby increasing the working time. In addition, it is not easy to insert the inner core into the outer layer, thereby wasting the time and energy of fabrication.

BRIEF SUMMARY OF THE INVENTION

The primary objective of the present invention is to provide a shoelace structure that is made easily and conveniently and is not loosened easily during a long-term utilization.

In accordance with the present invention, there is provided a shoelace structure an outer sleeve, a liner mounted in the outer sleeve, and an inner core mounted in the liner. The inner core includes a first weaving thread and a plurality of second weaving threads. The first weaving thread interweaves and intertwines with the second weaving threads along a lengthwise direction, with the second weaving threads being secured to the first weaving thread, thereby defining a plurality of enlarged portions and a plurality of separation portions. Each of the enlarged portions of the inner core has an outer diameter greater than that of the first weaving thread. The liner is formed by a plurality of fibers which are weaved together. The liner defines a cavity for receiving the inner core which is hidden in and covered by the cavity of the liner. The liner is squeezed by the enlarged portions of the inner core and defines a plurality of expanded sections and a plurality of recessed sections. The expanded sections of the liner respectively corresponds to the enlarged portions of the inner core, and the recessed sections of the liner respectively corresponds to the separation portions of the inner core. The outer sleeve defines a chamber for receiving the liner which contains the inner core.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
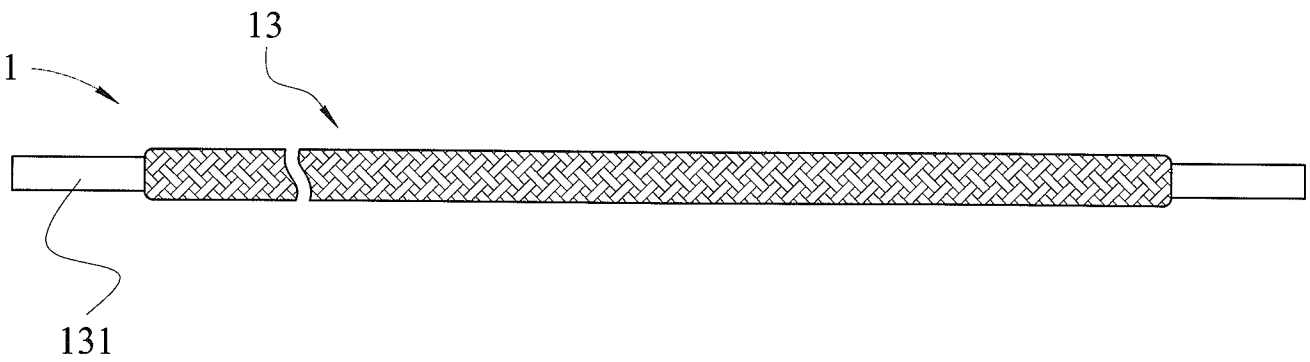
FIG. 1 is a planar view of a shoelace structure in accordance with the preferred embodiment of the present invention.
Figure 2:
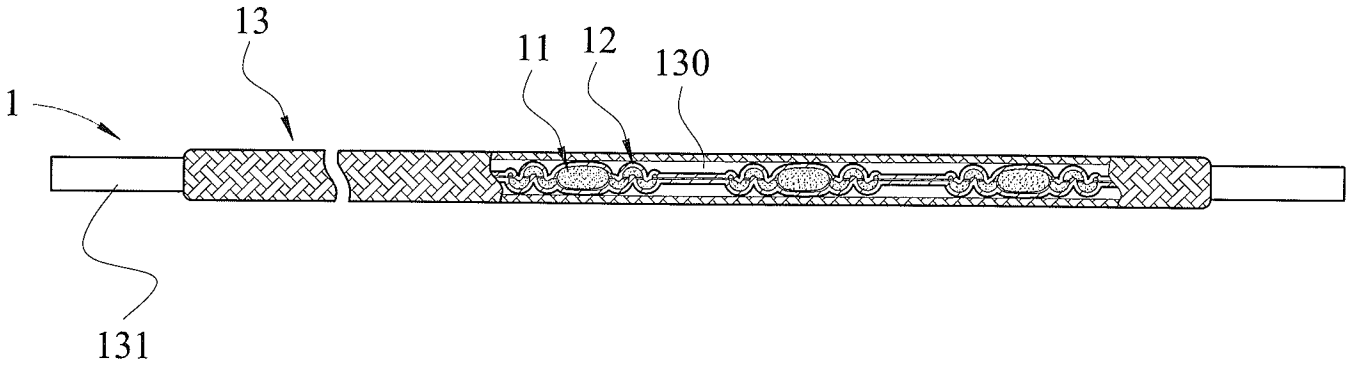
FIG. 2 is a partially cross-sectional view of the shoelace structure as shown in FIG. 1.
Figure 3:
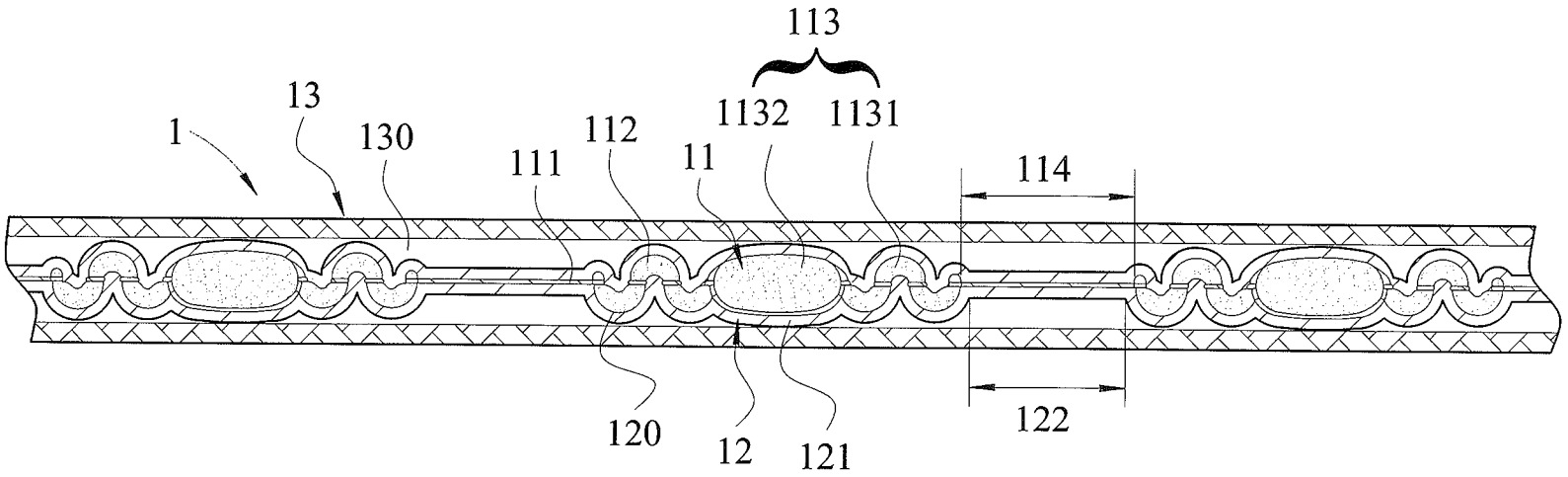
FIG. 3 is a locally enlarged view of the shoelace structure as shown in FIG. 2.

Referring to the drawings and initially to FIGS. 1-3, a shoelace structure 1 in accordance with the preferred embodiment of the present invention comprises an outer sleeve 13, a liner 12 mounted in the outer sleeve 13, and an inner core 11 mounted in the liner 12.

The inner core 11 includes a first weaving thread 111 and a plurality of second weaving threads 112. The first weaving thread 111 interweaves and intertwines with the second weaving threads 112 along a lengthwise direction, with the second weaving threads 112 being secured to the first weaving thread 111, thereby defining a plurality of enlarged portions 113 and a plurality of separation portions 114. Each of the enlarged portions 113 of the inner core 11 has an outer diameter greater than that of the first weaving thread 111.

In the preferred embodiment of the present invention, the enlarged portions 113 and the separation portions 114 of the inner core 11 are adjacent and arranged in an alternating manner. Each of the enlarged portions 113 of the inner core 11 has two opposite end portions 1131 and a middle portion 1132 located between the two end portions 1131. The first weaving thread 111 of the inner core 11 interweaves and intertwines with one of the two end portions 1131 of each of the enlarged portions 113, extends along the middle portion 1132 of each of the enlarged portions 113 and interweaves and intertwines with the other one of the two end portions 1131 of each of the enlarged portions 113. In such a manner, each of the two end portions 1131 of each of the enlarged portions 113 has a compact structure, and the middle portion 1132 of each of the enlarged portions 113 has a loose structure, so that the outer diameter of each of the enlarged portions 113 of the inner core 11 is greater than that of the first weaving thread 111. The enlarged portions 113 of the inner core 11 are distant from each other equally or unequally. Each of the second weaving threads 112 is made of cotton wool clump for interweaving and intertwining of the first weaving thread 111 to form the enlarged portions 113.

In another preferred embodiment of the present invention, the inner core 11 includes a plurality of first weaving threads 111 which initially interweave and intertwine with each other and then interweave and intertwine with the second weaving threads 112. In practice, when the first weaving threads 111 interweave along the lengthwise direction, the first weaving threads 111 interweave and intertwine with the second weaving threads 112 through a predetermined distance. Then, the second weaving threads 112 are cut. Then, the first weaving threads 111 interweave successively to form the separation portions 114. After the first weaving threads 111 interweave through a predetermined distance, the first weaving threads 111 again interweave and intertwine with the second weaving threads 112 to form the enlarged portions 113. After the first weaving threads 111 interweave and intertwine with the second weaving threads 112 through a predetermined distance, the second weaving threads 112 are cut. The above procedures are repeated to form the enlarged portions 113 and the separation portions 114.

The liner 12 is formed by a plurality of fibers which are weaved together. The fibers of the liner 12 are preferably made of polyester. The liner 12 defines a cavity 120 for receiving the inner core 11 which is hidden in and covered by the cavity 120 of the liner 12. The liner 12 is squeezed by the enlarged portions 113 of the inner core 11 and defines a plurality of expanded sections 121 and a plurality of recessed sections 122. The expanded sections 121 of the liner 12 respectively corresponds to the enlarged portions 113 of the inner core 11, and the recessed sections 122 of the liner 12 respectively corresponds to the separation portions 114 of the inner core 11.

The outer sleeve 13 is formed by a weaved fabric. The outer sleeve 13 defines a chamber 130 for receiving the liner 12 which contains the inner core 11. In the preferred embodiment of the present invention, the outer sleeve 13 has two ends each provided with a head 131. Preferably, the outer sleeve 13 has a constant outer diameter. Preferably, the outer sleeve 13 has a cylindrical or flat profile.

In fabrication, the inner core 11 extends into the cavity 120 of the liner 12 so that the inner core 11 is hidden in and covered by the cavity 120 of the liner 12 so as to increase the thickness of the inner core 11. Thus, the liner 12 containing the inner core 11 extends into the chamber 130 of the outer sleeve 13 conveniently, thereby saving the time and energy of fabrication. In addition, the liner 12 is formed by fibers, so that the shoelace structure 1 has a soft feature. Thus, the liner 12 is squeezed by the enlarged portions 113 of the inner core 11 to form a plurality of expanded sections 121 and a plurality of recessed sections 122 respectively corresponding to the enlarged portions 113 and the separation portions 114 of the inner core 11.

Figure 4:
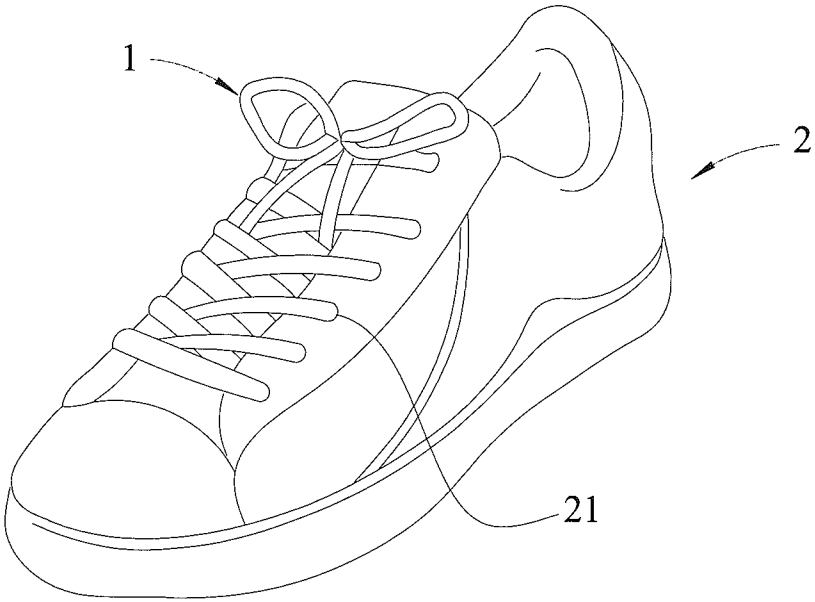
FIG. 4 is a perspective view showing usage of the shoelace structure for one shoe in accordance with the preferred embodiment of the present invention.
Figure 5:
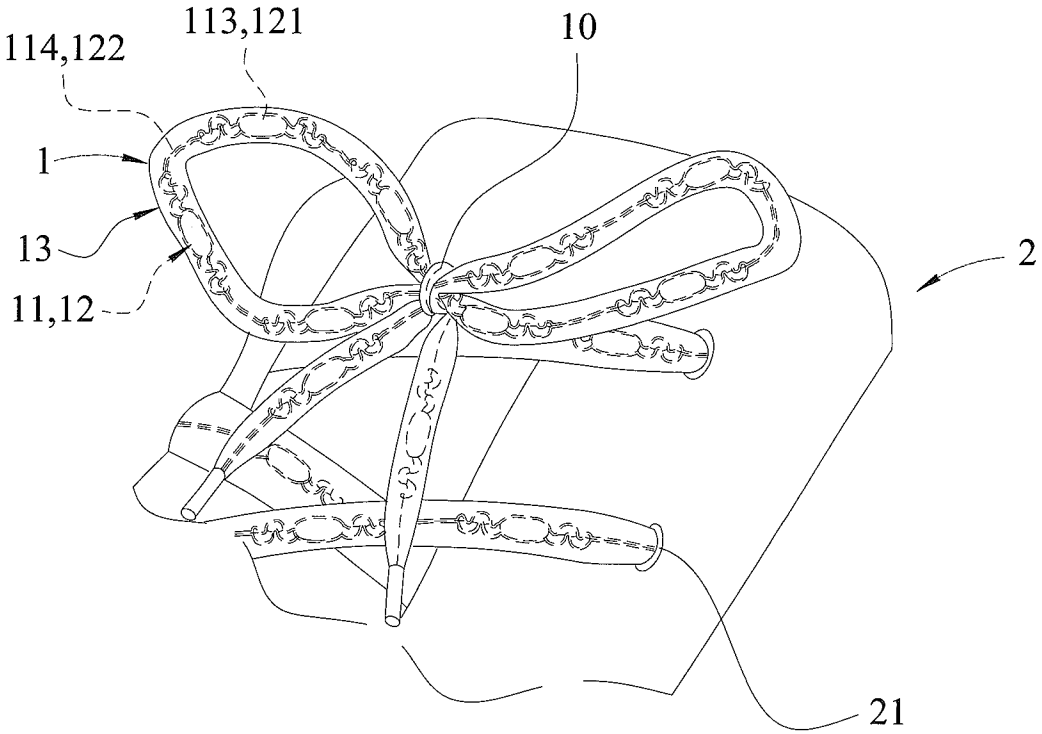
FIG. 5 is a locally enlarged view of the shoelace structure as shown in FIG. 4.

In use, referring to FIGS. 4 and 5 with reference to FIGS. 1-3, the shoelace structure 1 is mounted on one shoe 2 which has multiple eyelets 21. After the shoelace structure 1 extends through the eyelets 21 of the shoe 2, the shoelace structure 1 is tied. At this time, each of the recessed sections 122 of the liner 12 (corresponding to each of the separation portions 114 of the inner core 11) of the shoelace structure 1 rests on each of the eyelets 21 of the shoe 2. In such a manner, each of the recessed sections 122 of the liner 12 of the shoelace structure 1 is dragged and pressed by each of the eyelets 21 of the shoe 2 to present a compressed flat shape so as to achieve a tightly binding effect. Furthermore, each of the recessed sections 122 of the liner 12 (corresponding to each of the separation portions 114 of the inner core 11) of the shoelace structure 1 is located to function as a tie portion 10, so that each of the expanded sections 121 of the liner 12 (corresponding to each of the enlarged portions 113 of the inner core 11) of the shoelace structure 1 provides a tightly binding effect. Thus, when the shoelace structure 1 is stretched, the expanded sections 121 of the liner 12 of the shoelace structure 1 provide a restriction to prevent the shoelace structure 1 from slipping or becoming loosened.

Accordingly, the tie portion 10 is bound tightly by restriction of the expanded sections 121 of the liner 12 to prevent the shoelace structure 1 from slipping or becoming loosened during a long-term utilization, thereby facilitating the user using the shoelace structure 1. In addition, the shoelace structure 1 has a smooth profile by provision of the outer sleeve 13 so that the shoelace structure 1 is tied easily and conveniently. Further, the inner core 11 are made of the first weaving thread 111 and the second weaving threads 112, while the liner 12 is formed by fibers, so that the shoelace structure 1 has a soft feature. Further, the inner core 11 is formed directly by interweaving the first weaving thread 111 and the second weaving threads 112 to form the enlarged portions 113 and the separation portions 114, so that the shoelace structure 1 is made easily and quickly, without needing additional working procedures, thereby facilitating fabrication of the shoelace structure 1, and thereby decreasing the cost of fabrication.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A shoelace structure:

an outer sleeve;

a liner mounted in the outer sleeve; and an inner core mounted in the liner;

wherein:

the inner core includes a first weaving thread and a plurality of second weaving threads;

the first weaving thread interweaves and intertwines with the second weaving threads along a lengthwise direction, with the second weaving threads being secured to the first weaving thread, thereby defining a plurality of enlarged portions and a plurality of separation portions;

each of the enlarged portions of the inner core has an outer diameter greater than that of the first weaving thread;

the liner is formed by a plurality of fibers which are weaved together;

the liner defines a cavity for receiving the inner core which is hidden in and covered by the cavity of the liner;

the liner is squeezed by the enlarged portions of the inner core and defines a plurality of expanded sections and a plurality of recessed sections;

the expanded sections of the liner respectively corresponds to the enlarged portions of the inner core;

the recessed sections of the liner respectively corresponds to the separation portions of the inner core; and the outer sleeve defines a chamber for receiving the liner which contains the inner core.

2. The shoelace structure of claim 1, wherein the enlarged portions and the separation portions of the inner core are adjacent and arranged in an alternating manner.

3. The shoelace structure of claim 2, wherein each of the enlarged portions of the inner core has two opposite end portions and a middle portion located between the two end portions, and the first weaving thread of the inner core interweaves and intertwines with one of the two end portions of each of the enlarged portions, extends along the middle portion of each of the enlarged portions and interweaves and intertwines with the other one of the two end portions of each of the enlarged portions.

4. The shoelace structure of claim 3, wherein the enlarged portions of the inner core are distant from each other equally or unequally.

5. The shoelace structure of claim 1, wherein the outer sleeve has a constant outer diameter.

6. The shoelace structure of claim 5, wherein the outer sleeve has two ends each provided with a head.

7. The shoelace structure of claim 5, wherein the outer sleeve has a cylindrical or flat profile.

8. The shoelace structure of claim 1, wherein each of the second weaving threads is made of cotton wool clump for interweaving and intertwining of the first weaving thread to form the enlarged portions.

9. The shoelace structure of claim 1, wherein the inner core includes a plurality of first weaving threads which initially interweave and intertwine with each other and then interweave and intertwine with the second weaving threads.

10. The shoelace structure of claim 1, wherein the fibers of the liner are made of polyester.

* * * * *